United States Patent [19]

Kluckhuhn

[11] Patent Number: 4,526,122

[45] Date of Patent: Jul. 2, 1985

[54] LOAD DISTRIBUTION AND ANTI-SAG MEANS FOR LUFF FURLING SAILS

[76] Inventor: Fred H. Kluckhuhn, 1618 Severn Dr., Annapolis, Md. 21401

[21] Appl. No.: 587,647

[22] Filed: Mar. 8, 1984

[51] Int. Cl.[3] ..... B63H 9/10

[52] U.S. Cl. ..... 114/106; 114/107; 114/94

[58] Field of Search ..... 114/39, 94, 102, 103, 114/104, 105, 106, 107, 108, 111, 112

[56] References Cited

U.S. PATENT DOCUMENTS

| | | | |
|---|---|---|---|
| 4,143,611 | 3/1979 | Hayhurst | 114/112 |
| 4,269,134 | 5/1981 | Shapland | 114/107 |
| 4,324,192 | 4/1982 | Ingouf | 114/106 |

*Primary Examiner*—Trygve M. Blix
*Assistant Examiner*—Thomas J. Brahan
*Attorney, Agent, or Firm*—Scrivener Clarke Scrivener and Johnson

[57] ABSTRACT

Luff furling main and head sails are subject to sagging-off to leeward in heavy winds thereby decreasing the aerodynamic efficiency of the sails. The invention diminishes or eliminates this problem by providing a strip of sail cloth which may be interposed between the luff furling apparatus and a rigging member such as a mast or stay, the strip having a sliding connection with both members along their lengths whereby the load on the sail is transferred uniformly along the length of the rigging member and the furling apparatus is prevented from sagging to leeward.

10 Claims, 5 Drawing Figures

LOAD DISTRIBUTION AND ANTI-SAG MEANS FOR LUFF FURLING SAILS

This invention relates to furling apparatus for sails and more particularly to anti-sag means for minimizing the sagging of luff-furling sails to leeward with respect to an adjacent rigging member.

Though the invention will be described and illustrated in connection with a mast, it will be apparent to those skilled in the art that the invention need not necessarily be restricted to luff-furling of a main or mizzen sail adjacent to a mast, but is equally applicable to luff-furling of head sails adjacent to head stays. Thus herein after the term "rigging member" in the description and claims means any spar, such as a mast, or stay, such as a conventional head stay.

Luff-furling of head sails is a well known expedient and usually comprises a luff wire sewed into the luff seam of a head sail and attached to pivots at its upper and lower ends, the upper side of the upper pivot being attached to a halyard which can be tightened to maintain the luff wire as taut as possible. The lower pivot includes a drum around which a lanyard is wrapped when the sail is unfurled. To furl the sail, one simply pulls on the lanyard to rotate the drum and luff wire to wrap the sail about the luff wire. An improvement over the luff wire, which can sometimes rotate uselessly within the luff seam, is a rod-like member having a longitudinal slot in it for slideably receiving the bolt rope on the luff of the head sail.

Both the rod and wire luff furlers have been adapted for use with main sails whereby the main sail is furled about its luff rearwardly of the mast, it being understood that for either the head sail or main sail (or mizzen sail) the furling luff wire or rod is spaced from the mast or forestay a sufficient distance to accommodate the respective sails in furled conditions.

Though the described luff furling arrangements are quite satisfactory it will be apparent that the wires or rods are attached to fixed structures at only their upper and lower ends and there is no lateral support therebetween and no matter how hard one takes up on the halyards attached to the furling wires or rods, it is impossible to so tauten them as to prevent the luffs of the respective sails from sagging off to leeward, resulting in an alteration in the aerodynamic shapes of the sails which prevents the vessel from sailing as efficiently as it would, particularly to windward, if the luffs of the sails were supported uniformly along their lengths to rigid or near-rigid members such as a mast or a head stay.

This problem has been recognized and an attempt to alleviate the problem has been proposed in U.S. Pat. No. 4,269,134 wherein the luff furling apparatus is mounted in a vertical housing member whose forward longitudinal edge is hinged to the mast or forestay. Though that patent recognized the problem of a sagging luff, it only provided a partial solution inasmuch as lateral strain on the sail would still cause the luff rope to sag off to leeward to the extent permitted by the housing dimensions, which had to be of sufficient size to accommodate the furled sail, and that amount of space is about equal to the sag without any housing at all.

The object of the present invention is to eliminate substantially all sag of luff-furling apparatus by providing a strip of flexible material e.g. sail cloth, and providing along its forward and rearward longitudinal edges, means slideably and uniformly connecting the respective edges to the adjacent rigging member, e.g. mast or forestay, and the luff-furling apparatus.

Yet another object of the invention is to provide for luff-furling apparatus a means for transferring wind load on the sail along the length of the mast rather than merely at the upper end of the apparatus as presently is the case.

More specifically it is an object of the invention to provide a strip of flexible material which performs the foregoing functions.

Other objects and their attendant advantage will become apparent as the following detailed description is read in conjunction with the accompanying drawings wherein.

Figure 1:
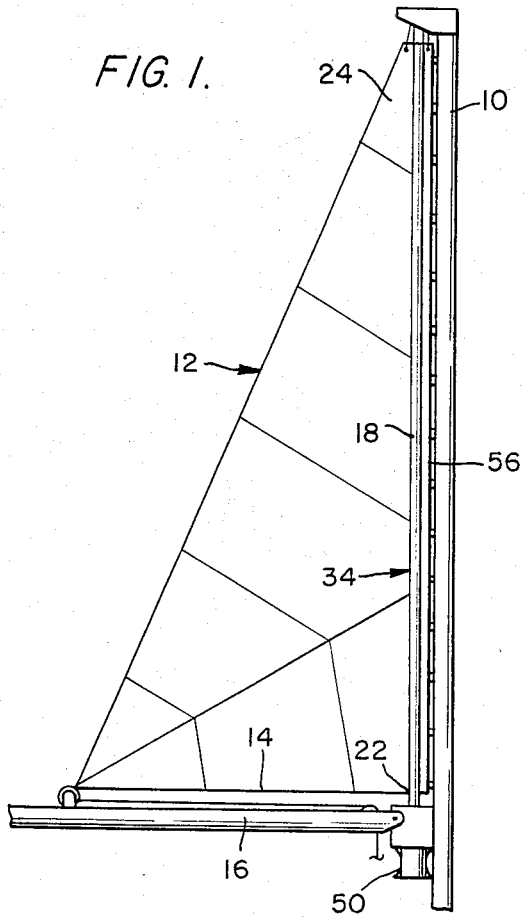
FIG. 1 is a somewhat schematic side elevational view of a furling reefing apparatus incorporating the present invention.
Figure 2:
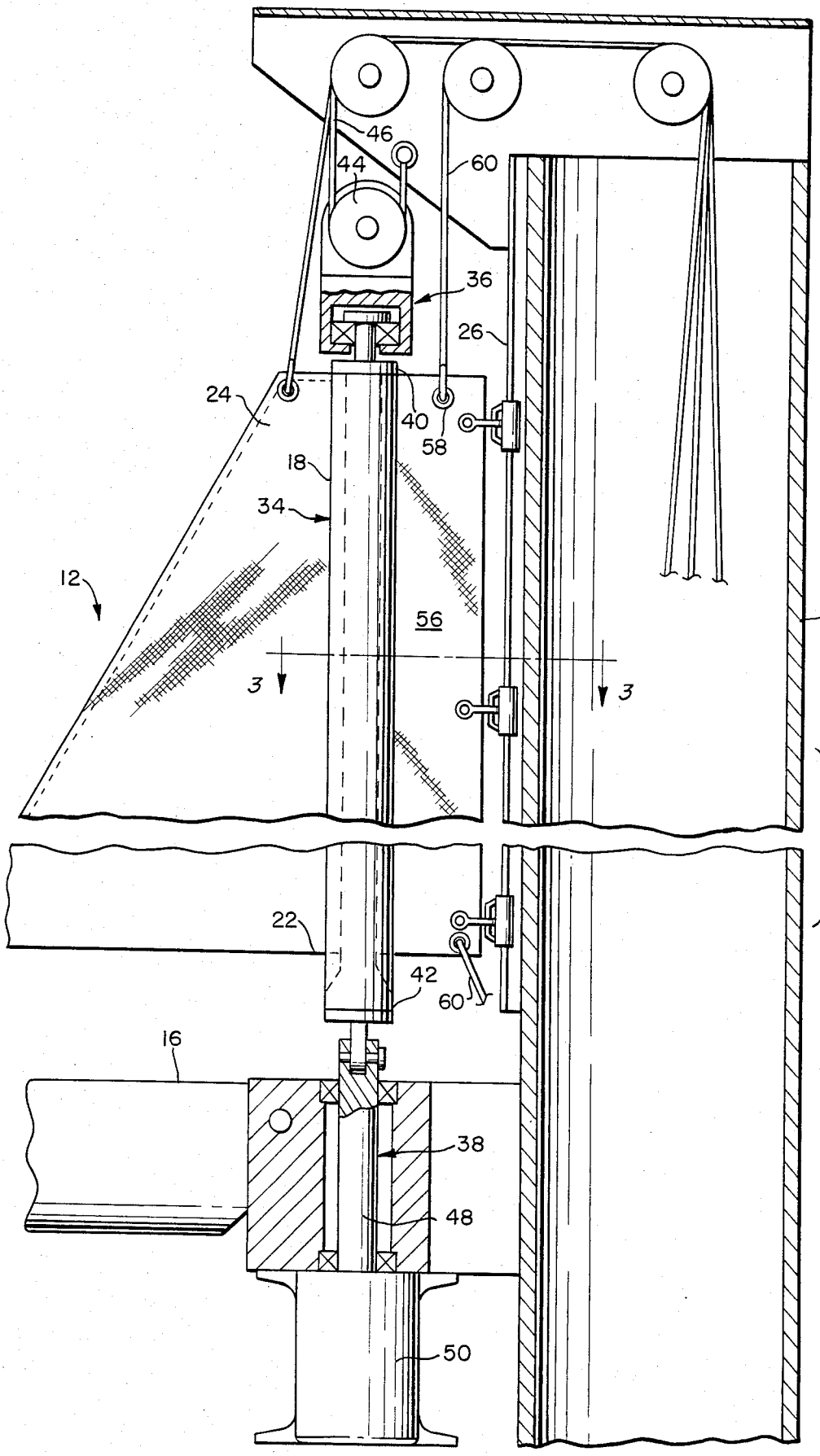
FIG. 2 is an enlarged somewhat schematic view, partly in vertical cross-section, showing one embodiment of my invention.

Referring now to FIGS. 1 and 2, 10 refers to a rigging member which, as shown, comprises a mast though those skilled in this art will appreciate that instead of a mast, the rigging member could be a forestay. The numeral 12 designates an unfurled main sail whose foot 14 is stretched "loose-footed", along the boom 16. The luff 18 of the sail is provided with a bolt rope 20 which extends from the tack 22 of the sail to its head 24.

Figure 4:
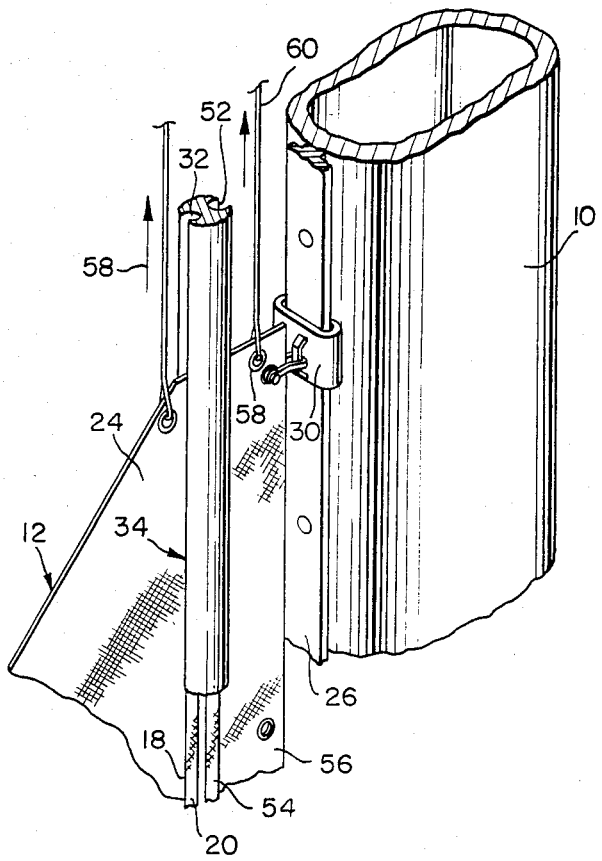
FIG. 4 is a broken perspective view showing the manner in which the invention is applied after the sail is hoisted and unfurled.
Figure 3:
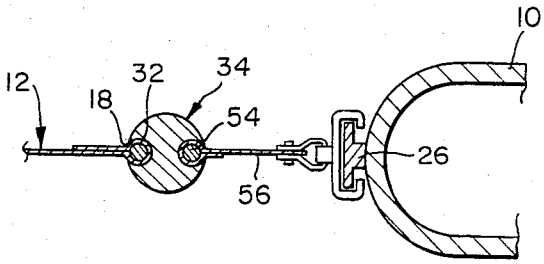
FIG. 3 is a horizontal cross-sectional view taken substantially on the line 3—3 of FIG. 2.
Figure 5:
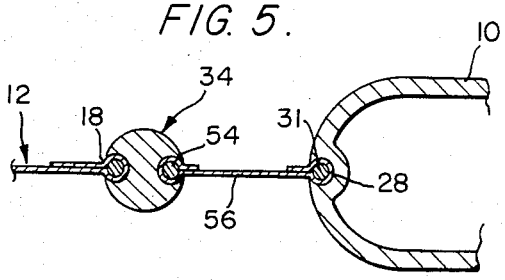
FIG. 5 is a horizontal cross-sectional view similar to FIG. 3 showing a variation.

Masts delivered with most vessels are supplied with means such as the external track 26 shown in FIGS. 2, 3 and 4 or an internal track or slot 28 as shown in FIG. 5. The external track is designed to slideably receive a plurality of spaced slides 30 attached along the sail luff, and the internal track or groove is designed to receive either a bolt rope 31 as in FIG. 5 on the sail luff or a plurality of spaced internal slides known as slugs.

Luff furling apparatus, particularly for head sails is old and luff furling for main sails is becoming popular. As explained above, earlier luff furling apparatus consisted of a rotatable wire sewn into the luff seam. More recently slotted rod-like members have become popular for furling, a single slot, corresponding to the slot 32 in the rod 34 as best seen in FIG. 4, being provided, the rod 34 being attached to pivot assemblies 36, 38 at their upper and lower ends 40, 42 in substantially parallel relationship to the adjacent mast or other rigging member as generally illustrated in FIG. 2. The upper pivot assembly 36 may be provided with a sheave 44 around which a halyard 46 is received and trained in a conventional manner down the interior of the hollow mast 10 to winch means (not shown) at the lower end of the mast and which may be turned to rigidify the rod-like member 34 as much as possible. The lower pivot assembly 38 is more or less schematically shown as comprising a shaft 48 pinned to the lower end 42 of the rod 34 and carrying at its lower end a drum 50 carrying a lanyard (not shown) which is wound onto the drum when the sail is unfurled and pulled to turn the drum in order to furl the sail. As is clear from the drawings, the axis defined by the pivot assemblies defines the sole pivot axis about which the sail rotates relative to an adjacent rigging member the sail moves between fore-and-aft and athwartship position.

Though double-slotted rods are available such rods are not utilized for luff furling purposes. In accordance with the invention, however, instead of a rod with a single slot 32, the double-slotted rod 34 is utilized having a second slot 52. The purpose of this slot is to receive a bolt rope 54 along the rear longitudinal edge of a strip of flexible material 56, preferably sail cloth, having a width substantially equal to the spaced distance between rod 34 and the rigging member such as the mast 10, this distance being at least great enough to accommodate the sail when in its furled condition. Attached along the front longitudinal edge of the strip is means for slideably connecting the strip to the rigging member, the connecting means in FIGS. 2, 3 and 4 comprising the conventional sail slides 30 mentioned above for engagement with the track 26, usually already in situ on the mast, or the connecting means could comprise a second bolt rope corresponding to the previously mentioned rope 31 as seen in FIG. 5 for engagement with the slot 28 in the mast. Instead of a bolt rope, slugs (not shown) attached to the strip similar to the slide 30 could be received in the slot in a conventional manner. For head sails, instead of the track slides shown, the slides could comprise conventional hanks which are snapped over the head stay in a well known manner.

The upper end of the strip is provided with suitable grommet means 58 to which a halyard 60 can be attached for controlling the raising and lowering of the strip 56.

In use, the furled sail is unfurled to the position of FIG. 1. While the vessel is in relatively calm air or when the sail is not otherwise loaded with wind, the strip head 58 is connected to the halyard 60 by suitable shackle means (not shown), the bolt rope 54 is fed into the forward slot 52 of the rod 34 and at the same time the slides 30 or the bolt rope 31 (or the jibhanks) are engaged with the track 26 or mast slot 28 (or with the forestay) and this process is continued until the strip is in its fully raised position of FIG. 2, it being understood that the sail 12 is normally already in its fully raised position where it remains almost continuously during any particular sailing season. (The arrow 58 in FIG. 4 is intended merely to illustrate the manner in which the sail is initially guided to its fully raised position of FIG. 2.) When the strip has been fully raised a down-haul line 60' shown in FIG. 2 is tightened and secured to suitable cleat means (not shown) at the foot of the mast. Upon the completion of the foregoing procedure, the vessel may be sailed hard on the wind with the result that the rod does not sag off to leeward as was the usual case prior to the present invention and the wind load is evenly distributed along the length of the rigging member. Because the sail only rotates with respect to the rigging member about the axis defined by the upper and lower pivot assemblies of the luff furling apparatus it follows that the rear edges of the strip cannot rotate with the sail and thus continues to provide anti-sag and load distribution effects for substantially every point of sailing. Upon completion of sailing, the strip is first lowered whereupon the sail may be furled in the usual manner.

A particular advantage of the invention is that it now encourages sailors, who have before refused to use luff furling because of the trade-off in sailing quality, to obtain the benefits of luff furling while still being provided with the means for maintaining the sailing ability of the vessel as if it were not equipped with luff-furling. A distinct advantage of the cloth strip is that not only does it distribute sail load uniformly along the mast, where before all the load on the mast was taken at the upper end of the rod, but the cloth strip is light and does not increase weight aloft as would a metal housing. Further, the strip increases effective sail area, is easily raised or lowered and can be stowed in a small sail bag.

It will be apparent that the invention is susceptible of a variety of modifications and changes without departing from the scope of the appended claims.

What is claimed is:

1. Anti-sag and load distribution means for minimizing the sag to leeward of a furling apparatus engaging the luff of a hoisted sail and for distributing the wind load on said sail uniformly along an adjacent rigging member, said furling apparatus having upper and lower pivoted connections at the head and tack of said sail and being substantially parallel to and freely spaced from an adjacent rigging member at least a distance sufficient to accomodate a furled sail wrapped around said furling apparatus, said connections defining the sole axis about which said sail rotates relative to said rigging member as the sail moves between fore-and-aft and athwartship positions, said means comprising a strip of flexible material having a width substantially equal to the spacing between said apparatus and said adjacent rigging member, and a heighth substantially equal to the length of a luff of said sail, first fastening means extending uniformly along one longitudinal edge of said strip for slideable connection with said adjacent rigging member, second fastening means extending uniformly along the opposite longitudinal edge of said strip for slideable connection with said furling apparatus when said sail is in its unfurled condition, and means on the upper end of said strip for detachable connection with halyard means for controlling the raising and lowering of said strip.

2. The anti-sag means of claim 1, wherein said first fastening means comprises a plurality of slides spaced along said one edge for releasable engagement with said rigging member.

3. The anti-sag means of claim 2, wherein said slide means comprise slides engageable with a track carried by a substantially rigid spar such as a mast.

4. The anti-sag means of claim 1, wherein said second fastening means along said opposite edge of said strip comprises a bolt rope adapted for slideable engagement with slot means carried by said furling apparatus.

5. The anti-sag means of claim 1, wherein said first fastening means comprises a bolt rope attached uniformly along said one edge and adapted for slideable engagement with slot means carried by said adjacent rigging member.

6. In combination, a rigging member, furling apparatus for furling a sail about its luff and means for connecting said furling apparatus to said rigging member to distribute the wind load on said sail along said rigging member and to minimize the sag of said furling apparatus away from said rigging member when a sail engaged with the furling apparatus is unfurled, said furling apparatus comprising a rod-like member having upper and lower ends and a length substantially equal to the luff of a sail, means pivotally supporting the upper and lower ends of said rod-like member so that it is substantially parallel to and spaced a distance away from said rigging member at least sufficient to accomodate a sail in furled condition, said last named means defining the sole pivot axis about which said sail rotates with respect to said rigging member as the sail moves between fore-and-aft and athwartship positions, and first means carried by said rod-like member for slideably and uniformly connecting the luff of a sail to the rod-like member, said means for connecting said furling apparatus to said rigging member when said sail is unfurled comprising a strip of flexible material having a length substantially equal to the length of said rod-like member, and a width between front and rear longitudinal edges substantially equal to the spaced distance between said rigging member and said furling apparatus, means on said front edge for slideable and uniformly connecting said front edge to said rigging member and means on said rear edge for slideably and uniformly connecting said rear edge to said rod-like member.

7. The combination of claim 6, wherein said rigging member comprises a mast, the means on said front edge of said strip comprising slide means engageable with complementary track means on said mast.

8. The combination of claim 7, wherein the first means carried by said rod-like member for connecting the luff of said sail thereto comprises a slot engageable by a bolt rope on the luff of said sail, a second slot on said rod-like member, and the means on the rear edge of said strip for connecting said edge to said rod-like member comprising a bolt rope engageable with said second slot.

9. The combination of claim 6, wherein the first means carried by said rod-like member for connecting the luff of said sail thereto comprises a slot engageable by a bolt rope on the luff of said sail, a second slot on said rod-like member, and the means on the rear edge of said strip for connecting said edge to said rod-like member comprising a bolt rope engageable with said second slot.

10. The combination of claim 6, including means carried by one end of said strip engageable by halyard means for controlling the raising and lowering of said strip relative to said rod-like member.

* * * * *